US009951570B2

(12) United States Patent
Pratt et al.

(10) Patent No.: US 9,951,570 B2
(45) **Date of Patent: *Apr. 24, 2018**

(54) COMPENSATING BAILS

(71) Applicant: Weatherford Technology Holdings, LLC, Houston, TX (US)

(72) Inventors: Brittan S. Pratt, Houston, TX (US); Karsten Heidecke, Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/277,290

(22) Filed: Sep. 27, 2016

(65) Prior Publication Data

US 2017/0016285 A1 Jan. 19, 2017

Related U.S. Application Data

(62) Division of application No. 14/041,841, filed on Sep. 30, 2013, now Pat. No. 9,476,268.

(60) Provisional application No. 61/709,089, filed on Oct. 2, 2012.

(51) Int. Cl.

| | |
|---|---|
| ***E21B 19/16*** | (2006.01) |
| ***E21B 19/06*** | (2006.01) |
| *E21B 17/042* | (2006.01) |
| *E21B 19/14* | (2006.01) |

(52) U.S. Cl.

CPC ..... *E21B 19/06* (2013.01); *E21B 19/16* (2013.01); *E21B 17/042* (2013.01); *E21B 19/14* (2013.01)

(58) Field of Classification Search

CPC ..... E21B 19/06; E21B 19/16

See application file for complete search history.

(56) References Cited

U.S. PATENT DOCUMENTS

| | | | |
|---|---|---|---|
| 1,086,772 | A | 2/1914 | Hoxie |
| 2,712,932 | A | 7/1955 | Gould |
| 3,351,372 | A | 11/1967 | Marks et al. |
| 3,365,081 | A | 1/1968 | Mclerran |

(Continued)

FOREIGN PATENT DOCUMENTS

| | | | |
|---|---|---|---|
| EP | 0560607 | A1 | 9/1993 |
| WO | 09607009 | A2 | 3/1996 |

OTHER PUBLICATIONS

Australian Patent Examination Report dated Nov. 25, 2016, for Australian Application No. 2013327473.

(Continued)

*Primary Examiner* — David J Bagnell
*Assistant Examiner* — Michael A Goodwin
(74) *Attorney, Agent, or Firm* — Patterson + Sheridan, LLP

(57) ABSTRACT

A pipe handler for assembling and deploying a string of threaded tubulars into a wellbore includes a pair of compensating bails and an elevator pivotally connected to the compensating bails. Each compensating bail includes: a first bail segment; a second bail segment; and a compensator connecting the respective first and second bail segments. Each compensator includes a load cylinder connected to the respective first bail segment and a linear actuator disposed in the respective load cylinder and operable to retract the respective second bail segment from a hoisting position to a ready position. Each second bail segment is engaged with the respective load cylinder in the hoisting position. The compensating bails are capable of supporting string weight in the hoisting position.

20 Claims, 8 Drawing Sheets

(56) References Cited

U.S. PATENT DOCUMENTS

| | | | |
|---|---|---|---|
| 3,857,450 | A | 12/1974 | Guier |
| 4,791,997 | A | 12/1988 | Krasnov |
| 4,793,422 | A | 12/1988 | Krasnov |
| 4,800,968 | A | 1/1989 | Shaw et al. |
| 5,125,148 | A | 6/1992 | Krasnov |
| 5,645,131 | A | 7/1997 | Trevisani |
| 6,056,060 | A | 5/2000 | Abrahamsen et al. |
| 6,520,709 | B1 | 2/2003 | Mosing et al. |
| 6,527,047 | B1 | 3/2003 | Pietras |
| 6,527,493 | B1 | 3/2003 | Kamphorst et al. |
| 6,536,520 | B1 | 3/2003 | Snider et al. |
| 6,820,505 | B2 | 11/2004 | Veverica et al. |
| 6,975,868 | B2 | 12/2005 | Joshi et al. |
| 6,978,844 | B2 | 12/2005 | LaFleur |
| 7,140,443 | B2 | 11/2006 | Beierbach et al. |
| 8,127,836 | B1 | 3/2012 | Keast et al. |
| 8,365,834 | B2 | 2/2013 | Liess et al. |
| 2007/0062688 | A1 | 3/2007 | Schats et al. |
| 2009/0229837 | A1 | 9/2009 | Wiens et al. |
| 2010/0080670 | A1 | 4/2010 | Henderson et al. |
| 2010/0183418 | A1 | 7/2010 | Henderson et al. |
| 2012/0217066 | A1 | 8/2012 | Smith et al. |
| 2013/0192859 | A1 | 8/2013 | Holiday et al. |
| 2014/0196954 | A1 | 7/2014 | Mahmood et al. |

OTHER PUBLICATIONS

Weatherford Tubular Running Services Brochure regarding AutoSeal™ II Fill-up and Circulation Tools, 2011, 6 pages.

COMPENSATING BAILS

BACKGROUND OF THE DISCLOSURE

Field of the Disclosure

The present disclosure generally relates to compensating bails.

Description of the Related Art

In wellbore construction and completion operations, a wellbore is formed to access hydrocarbon-bearing formations (e.g., crude oil and/or natural gas) by the use of drilling. Drilling is accomplished by utilizing a drill bit that is mounted on the end of a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a section of casing is lowered into the wellbore. An annulus is thus formed between the string of casing and the formation. The casing string is hung from the wellhead. A cementing operation is then conducted in order to fill the annulus with cement. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

Drill strings and casing strings are typically assembled by screwing together threaded joints end to end. As the joints are screwed together, allowance must be made for longitudinal displacement of the couplings as one is rotated relative to the other. Such displacement is accounted for using a thread (aka joint) compensator. Several prior art compensators are not designed to support an entire string of joints and/or do not inhibit or prevent undesirable movement of such joints within a derrick, particularly unwanted movement of a top end of a stand of joints in a derrick. One such system uses a compensator disposed between a travelling block and a typical elevator. A cable or cables are interposed between the compensator and the elevator. If a stand of multiple joints is lifted with such a system, it is possible for the top of the stand to whip around in the derrick due to the freedom of movement permitted by the cable(s).

When a joint compensator is used to support only one joint, once the single joint has been moved in and connected to a string that hangs from the slips in the rotary table, the joint compensator must be disconnected and moved out of the way, then a lifting elevator is connected to the string below the travelling block to support the entire string. Single joint compensators also cannot be used with a top drive, since an accidental overpull can result during a break out operation when the weight of an entire string is inadvertently applied to the compensator.

SUMMARY OF THE DISCLOSURE

The present disclosure generally relates to compensating bails. In one embodiment, a pipe handler for assembling and deploying a string of threaded tubulars into a wellbore includes a pair of compensating bails and an elevator pivotally connected to the compensating bails. Each compensating bail includes: a first bail segment; a second bail segment; and a compensator connecting the respective first and second bail segments. Each compensator includes a load cylinder connected to the respective first bail segment and a linear actuator disposed in the respective load cylinder and operable to retract the respective second bail segment from a hoisting position to a ready position. Each second bail segment is engaged with the respective load cylinder in the hoisting position. The compensating bails are capable of supporting string weight in the hoisting position.

In another embodiment, a method of assembling and deploying a string of threaded tubulars into a wellbore includes engaging a pipe handler with one or more joints of the threaded tubulars. The pipe handler has an elevator and a pair of bails and each bail has an integral compensator. The method further includes hoisting and swinging the joints over the string using the pipe handler; operating the compensators to a ready position; stabbing the joints into the string; and making up a threaded connection between the joints and the string while operating the compensators to maintain the joints in a neutral or substantially neutral condition.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1:
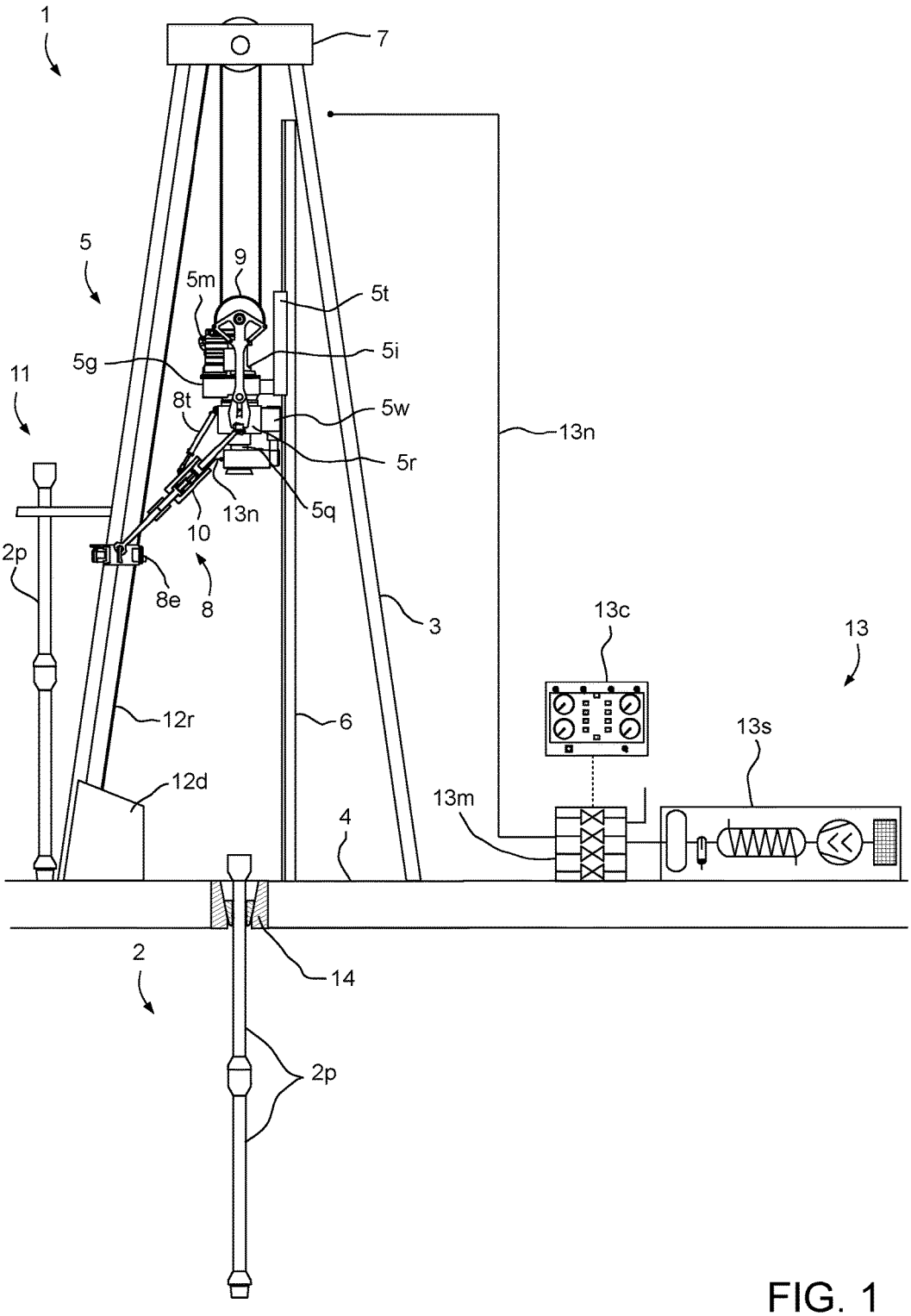
FIG. 1 illustrates a drilling rig in a drilling mode, according to one embodiment of the present disclosure.

FIG. 1 illustrates a drilling rig 1 in a drilling mode, according to one embodiment of the present disclosure. The drilling rig 1 may be part of a drilling system further including a fluid handling system (not shown), a blowout preventer (BOP, not shown), and a drill string 2. The drilling rig 1 may include a derrick 3 having a rig floor 4 at its lower end, a top drive 5, a hoist, and a fluid power unit 13. The rig floor 4 may have an opening through which the drill string 2 extends downwardly through the BOP and into a wellbore (not shown).

Figure 4A:
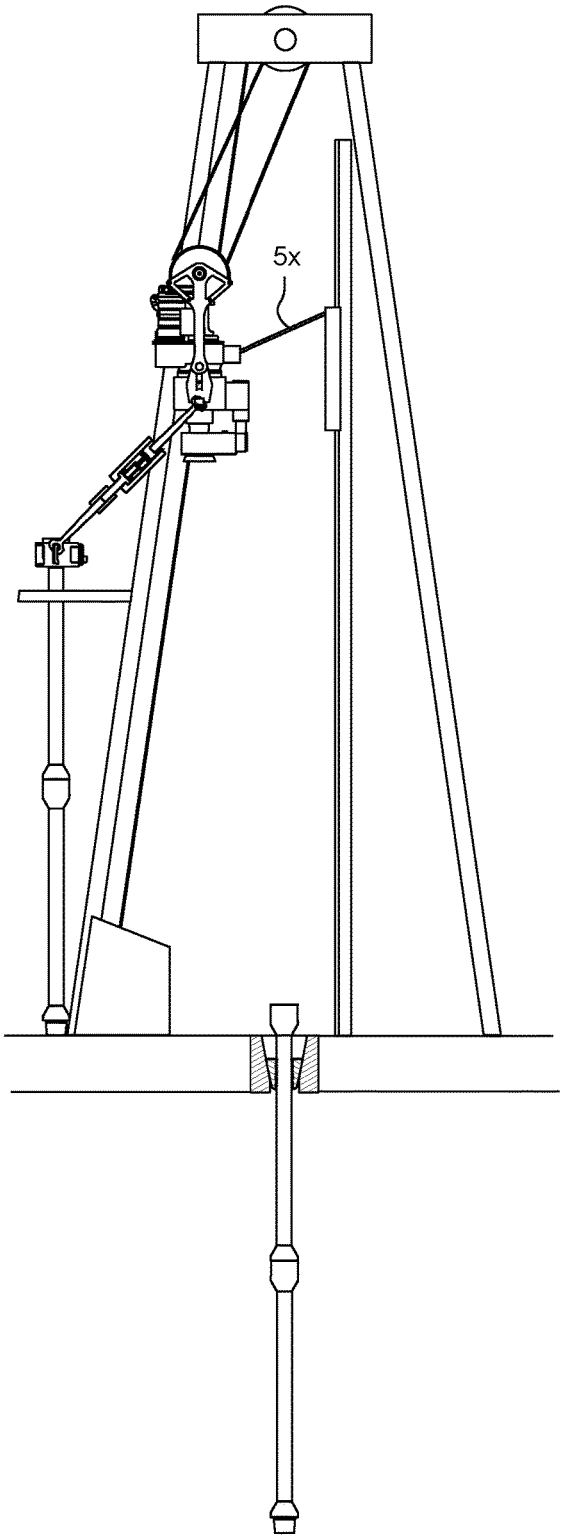
FIGS. 4A-4D illustrate extension of the drill string using the compensating bails.
Figure 4B:
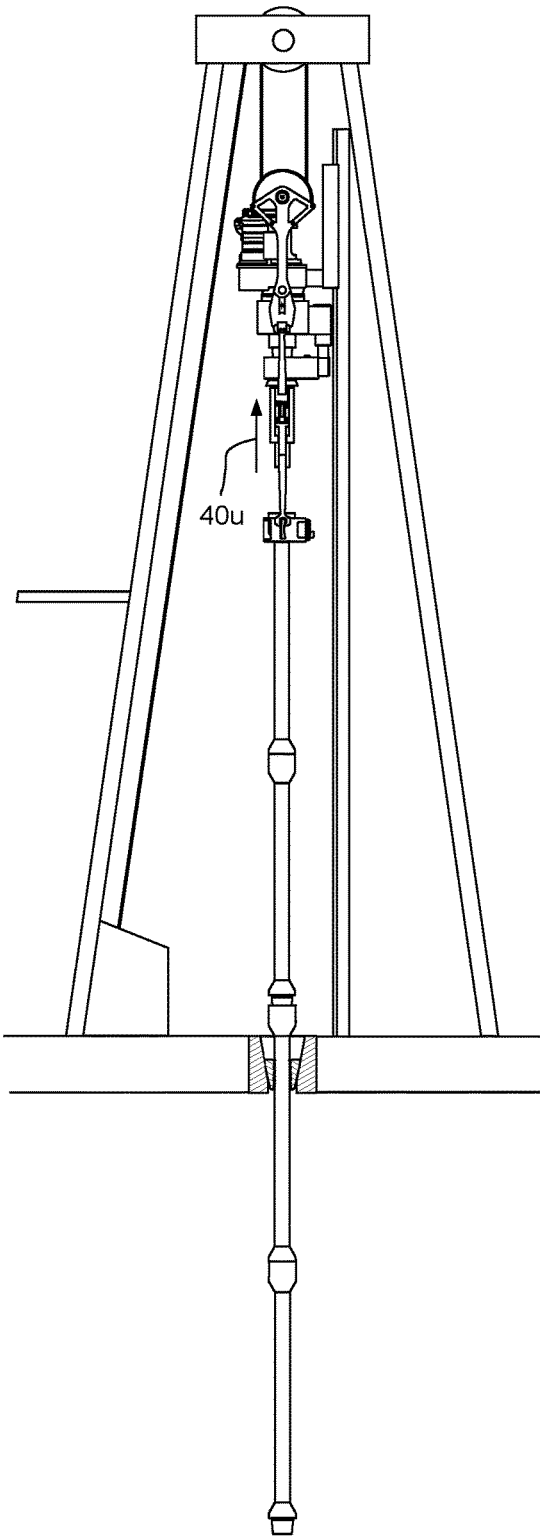
Figure 4C:
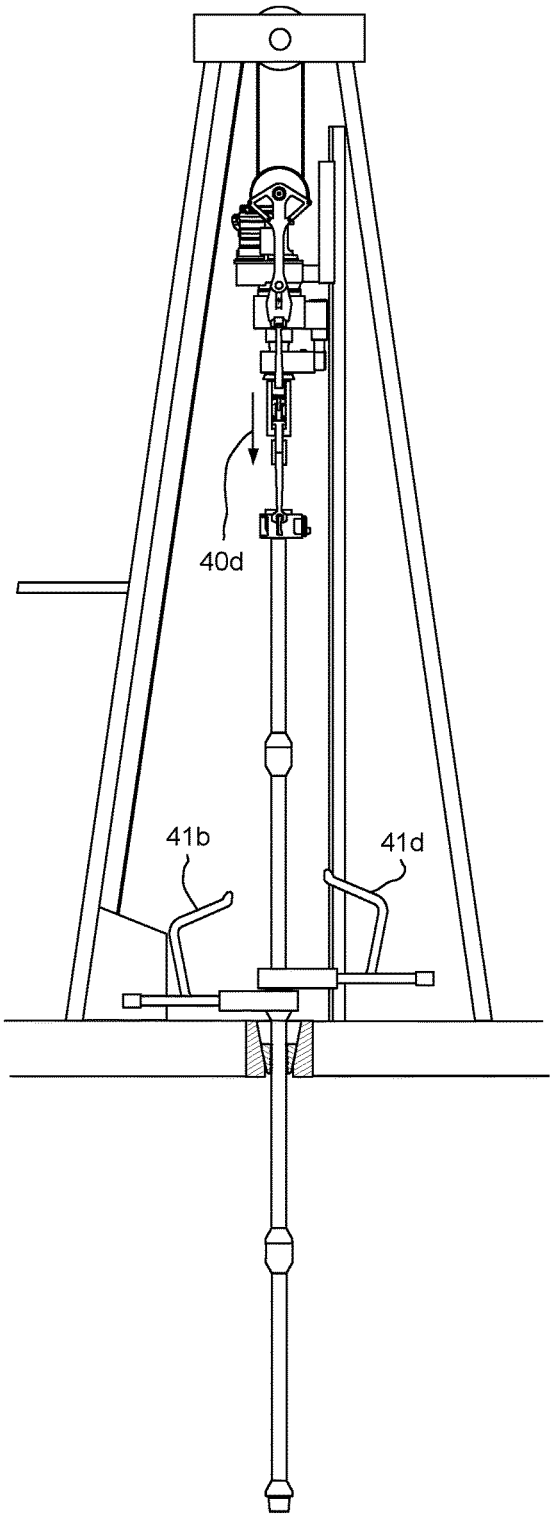

The drilling rig 1 may further include a rail 6 extending from the rig floor 4 toward a crown block 7 of the hoist. The top drive 5 may include an extender 5*x* (FIG. 4A), a motor 5*m*, an inlet 5*i*, a gear box 5*g*, a swivel 5*r*, a quill 5*q*, a trolley 5*t*, a pipe handler 8, and a backup wrench 5*w*. The top drive motor 5*m* may be electric or hydraulic and have a rotor and a stator. The motor 5*m* may be operable to rotate the rotor relative to the stator which may also torsionally drive the quill 5*q* via one or more gears (not shown) of the gear box 5*g*. The quill 5*q* may have a coupling (not shown), such as splines, formed at an upper end thereof and torsionally connecting the quill to a mating coupling of one of the gears. Housings of the motor 5*m*, swivel 5*r*, gear box 5*g*, and backup wrench 5*w* may be connected to one another, such as by fastening, so as to form a non-rotating frame. The top drive 5 may further include an interface (not shown) for receiving power and/or control lines.

The extender 5*x* may torsionally connect the frame to the trolley 5*t* and include one or more arms and an actuator, such as a piston and cylinder assembly (PCA). The extender arms may pivotally connect to the frame and trolley 5*t* such that operation of the extender actuator may horizontally extend or retract the frame (and rotating components) relative to the trolley 5*t* and rail 6. The trolley 5*t* may ride along the rail 6, thereby torsionally restraining the frame while allowing vertical movement of the top drive 5 with a travelling block 9 of the rig hoist. The traveling block 9 may be connected to the frame, such as by fastening to suspend the top drive 5 from the derrick 3. The swivel 5*r* may include one or more bearings (not shown) for longitudinally and radially supporting rotation of the quill 5*q* relative to the frame. The inlet 5*i* may have a coupling for connection to a Kelly hose (not shown) and provide fluid communication between the Kelly hose and a bore of the quill 5*q*. The quill 5*q* may have a coupling, such as a threaded pin, formed at a lower end thereof for connection to a mating coupling, such as a threaded box, of the drill string 2.

Alternatively, the top drive 5 may include a becket for receiving a hook of the traveling block 9. Alternatively, a Kelly and rotary table may be used instead of a top drive.

The pipe handler 8 may include an elevator 8*e*, a pair (only one shown) of compensating bails 10, and a link tilt 8*t*. Each bail 10 may have an eyelet formed at each longitudinal end thereof. An upper eyelet of each bail 10 may be received by a respective lifting lug of the top drive frame, thereby pivotally connecting the bails to the top drive 5. A lower eyelet of each bail 10 may be received by a respective lifting lug of the elevator 8*e*, thereby pivotally connecting the bails to the elevator. The link tilt 8*t* may include a pair (only one shown) of PCAs for swinging the elevator 8*e* relative to the top drive frame. Each link tilt PCA may have a coupling, such as a hinge knuckle, formed at each longitudinal end thereof. An upper hinge knuckle of each PCA may be received by a respective complementary hinge knuckle of the top drive frame, thereby pivotally connecting the PCAs to the top drive 5 (when fastened together by a hinge pin). A lower hinge knuckle of each PCA may be received by a complementary hinge knuckle of the respective bail 10, thereby pivotally connecting the PCAs to the bails (when fastened together by a hinge pin).

The elevator 8*e* may be manually opened and closed or the pipe handler 8 may include an actuator (not shown) for opening and closing the elevator. The elevator 8*e* may include a bushing having a profile, such as a bottleneck, complementary to an upset formed in an outer surface of the drill pipe 2*p* adjacent to the threaded coupling thereof. The bushing may receive the drill pipe 2*p* for hoisting one or more joints thereof, such as stand 11 preassembled with two (or more) joints. The pipe handler 8 may deliver the stand 11 to the drill string 2 where the stand 11 may be assembled therewith to extend the drill string during a drilling operation. The pipe handler 8 may be capable of supporting the weight of the drill string 2 (as opposed to a single joint elevator which is only capable of supporting the weight of the stand 11).

Alternatively, the elevator 8*e* may have a gripper, such as slips and a cone, capable of engaging an outer surface of the drill pipe 2*p* at any location therealong.

The fluid power unit 13 may include a compressed air supply 13*s*, a pneumatic manifold 13*m* and a control console 13*c*. A control line 13*n* may have a fluid conduit, such as a hose, and may provide fluid communication between the bails 10 and the pneumatic manifold 13*m*. The pneumatic manifold 13*m* may have one or more control valves controlled by the console 13*c* for operation of the bails 10. The pneumatic manifold 13*m* may be fed by the compressed air supply 13*s*.

Alternatively, the supply 13*s* may provide compressed nitrogen instead of air. Alternatively, the fluid power unit 13 may be hydraulic. Additionally, the fluid power unit 13 may include one or more additional conduits for operation of the link tilt 8*t* and/or the elevator actuator.

Figure 4D:
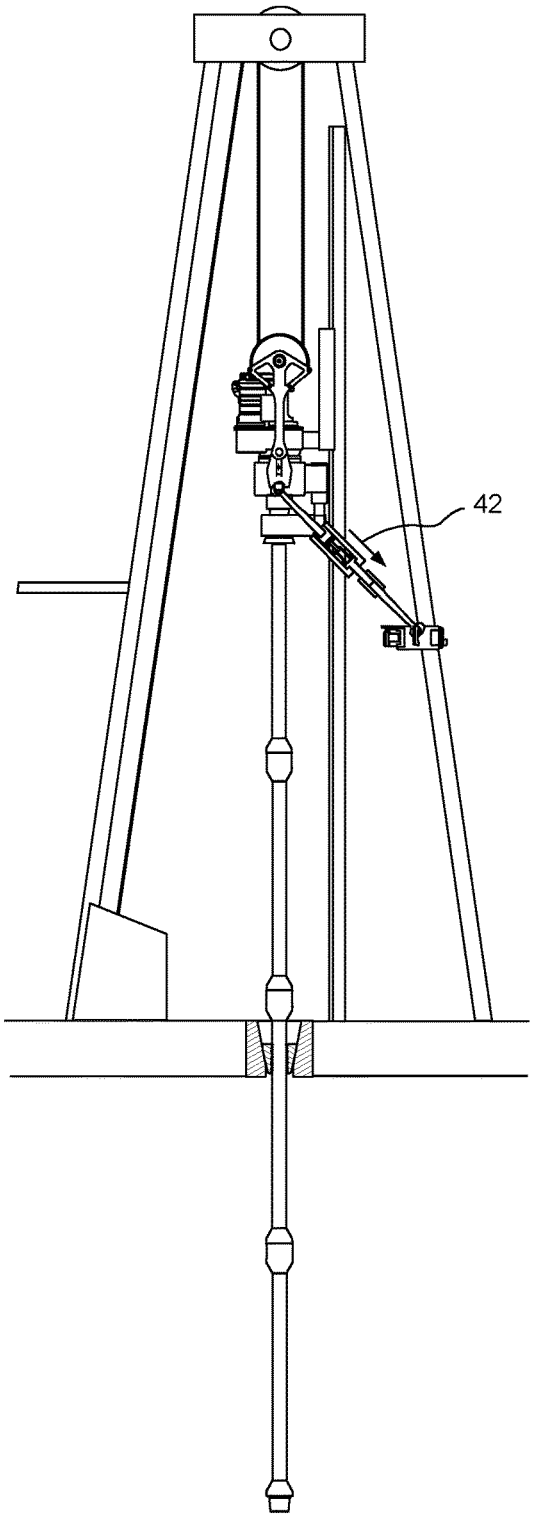
Figure 6A:
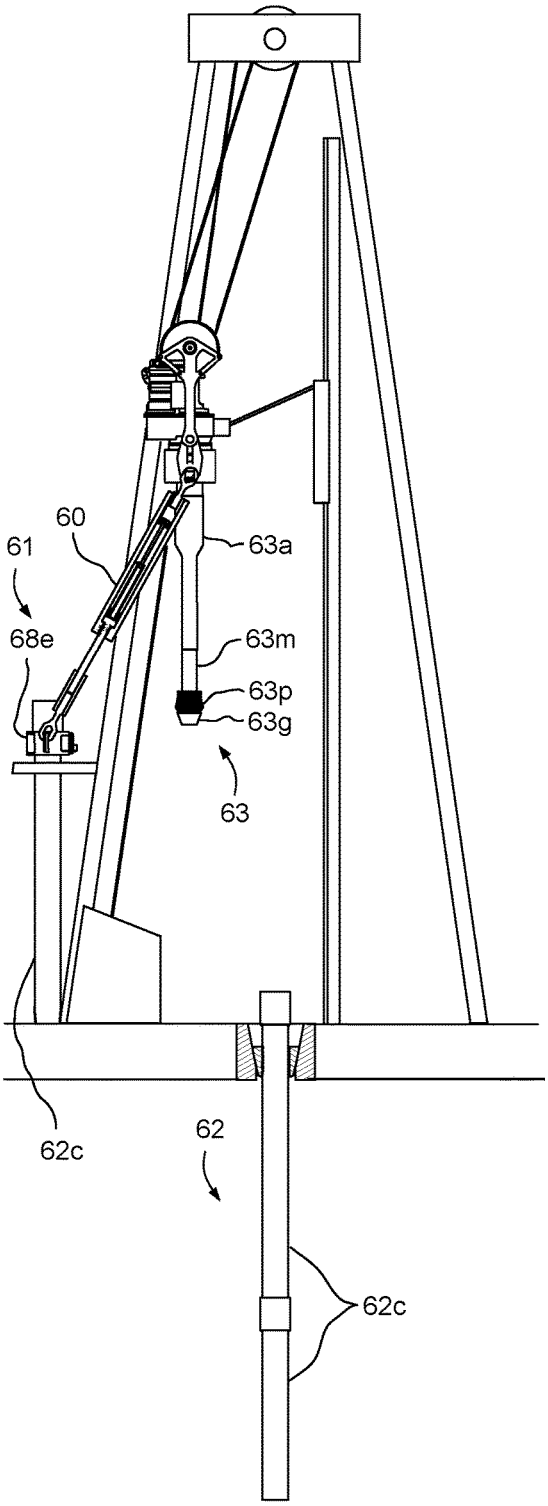
FIGS. 6A-6F illustrate the drilling rig in a casing mode and extension of a casing string using compensating bails, according to another embodiment of the present disclosure.
Figure 6B:
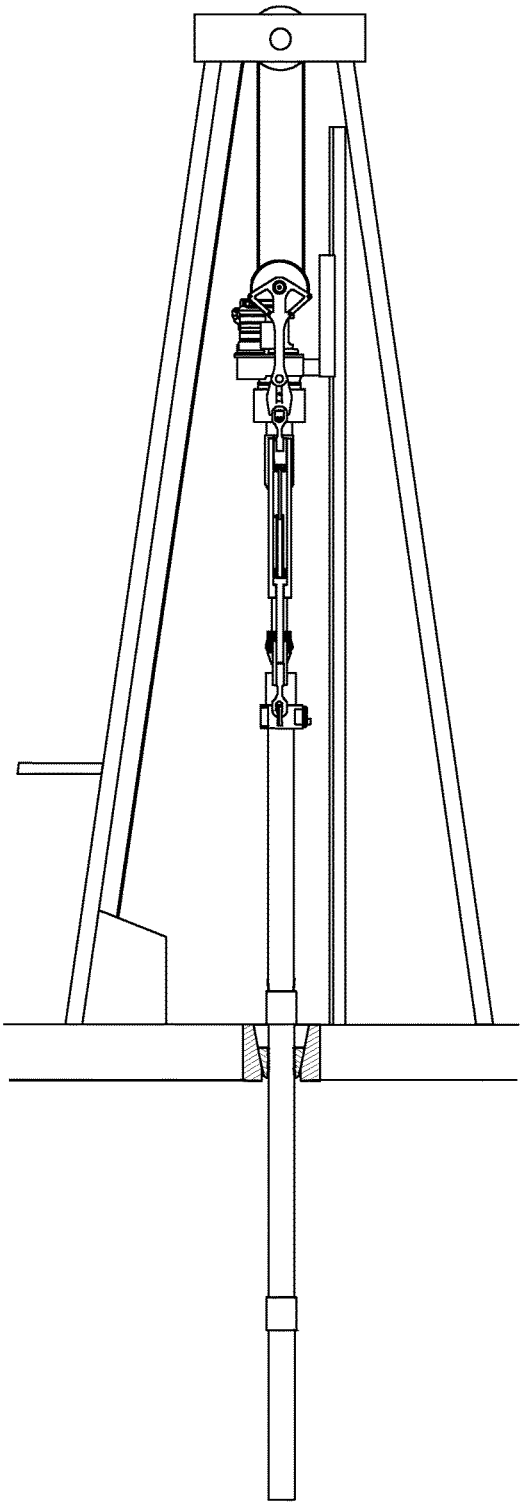
Figure 6C:
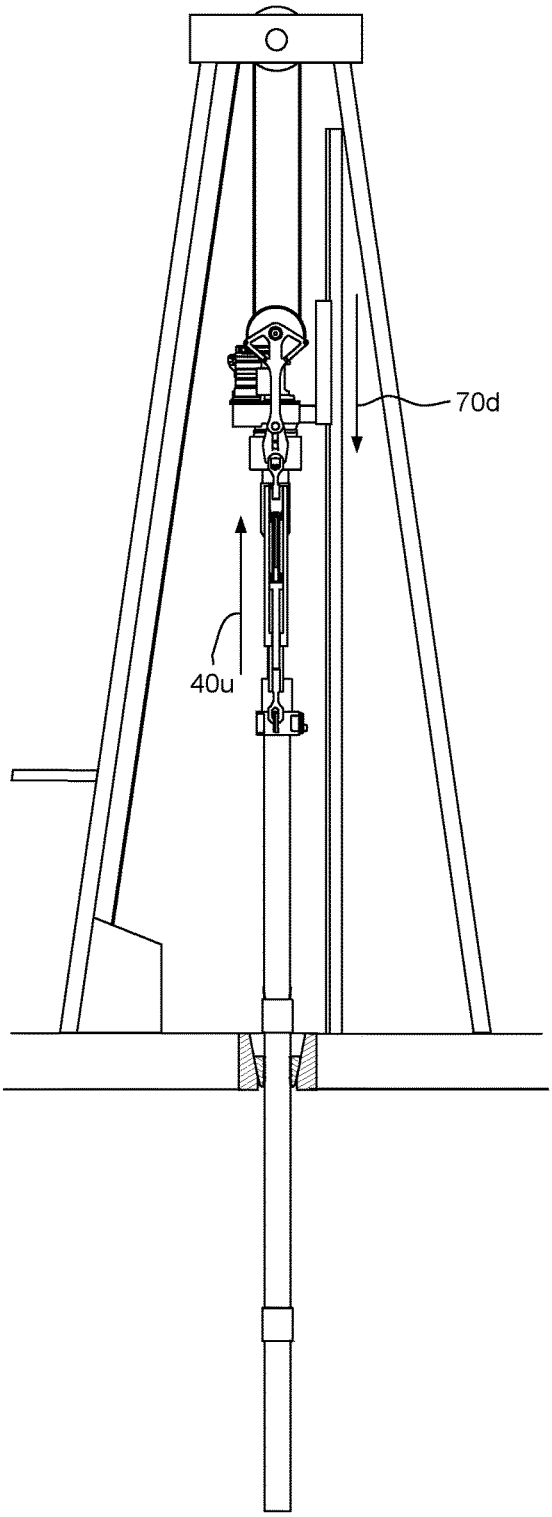
Figure 6D:
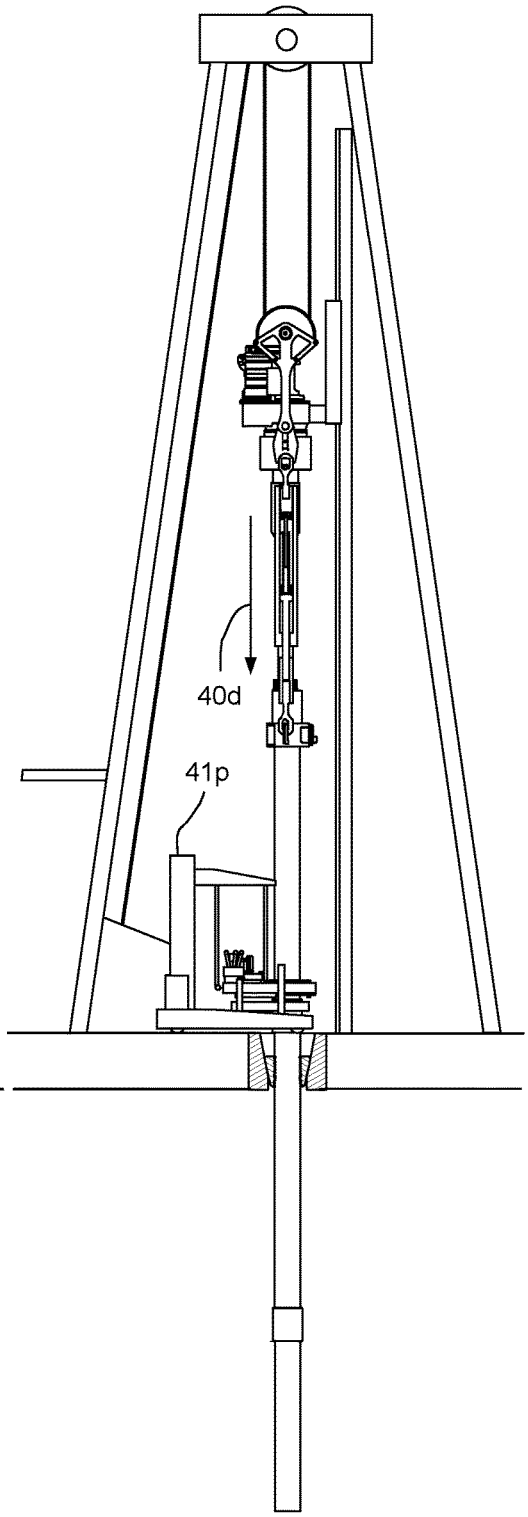
Figure 6E:
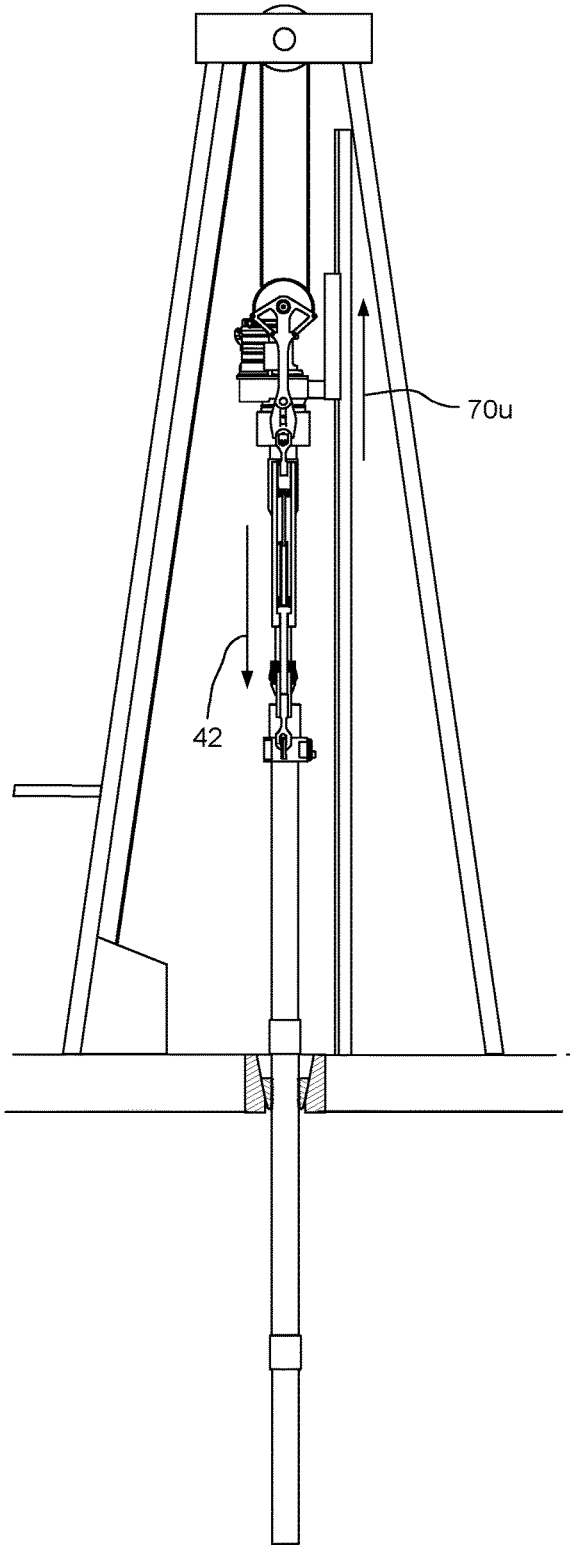
Figure 6F:
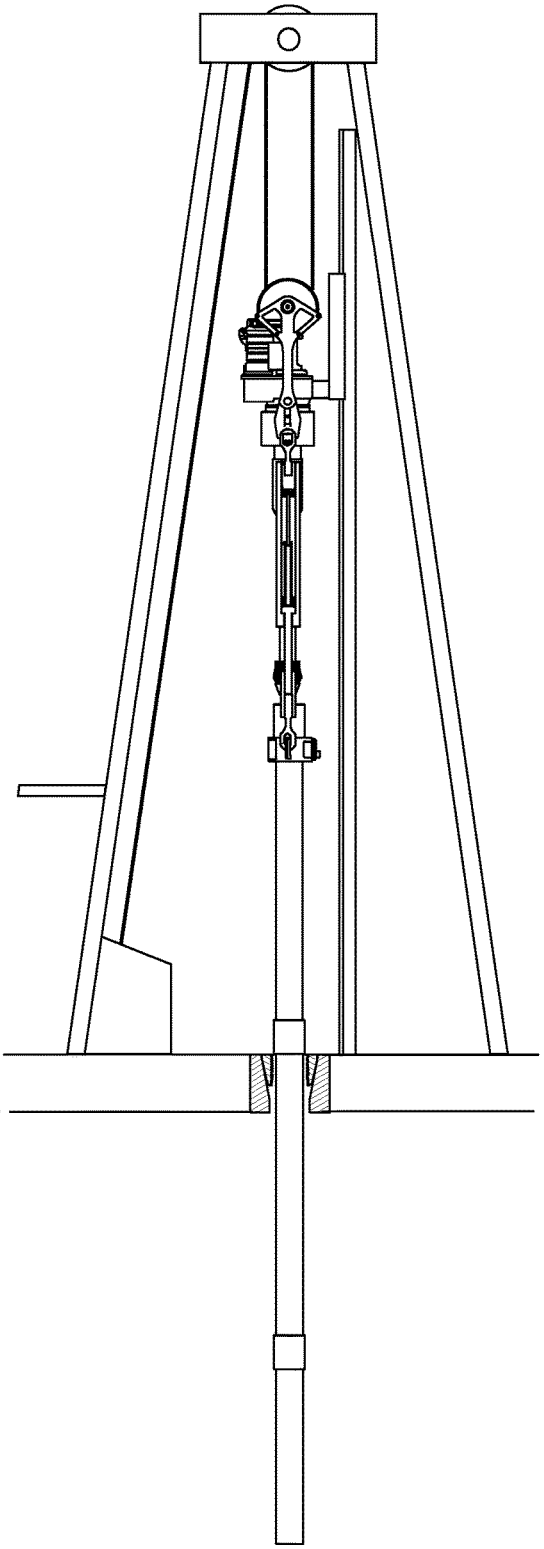

The backup wrench 5*w* may include a tong, a telescoping arm, an arm actuator (not shown), and a tong actuator (not shown). The telescoping arm may torsionally connect the tong to the top drive frame while allowing the arm actuator to longitudinally move the tong relative to the frame. The tong may include a pair of jaws and the tong actuator may radially move one of the jaws radially toward or away from the other jaw. The arm actuator may also operate as a thread compensator while making up a threaded connection between the quill 5*q* and the stand 11 (FIG. 4D).

The traveling block 9 may be supported by wire rope 12*r* connected at its upper end to the crown block 7. The wire rope 12*r* may be woven through sheaves of the blocks 7, 9 and extend to drawworks 12*d* for reeling thereof, thereby raising or lowering the traveling block 9 relative to the derrick 3.

The drill string 2 may include a bottomhole assembly (BHA, not shown) and a conveyor. The conveyor may include joints of drill pipe 2*p* connected together, such as by threaded couplings. The BHA may be connected to the conveyor, such as by threaded couplings, and include a drill bit and one or more drill collars connected thereto, such as by threaded couplings. The drill bit may be rotated by the top drive 5 via the conveyor and/or the BHA may further include a drilling motor (not shown) for rotating the drill bit. The BHA may further include an instrumentation sub (not shown), such as a measurement while drilling (MWD) and/or a logging while drilling (LWD) sub.

Alternatively, the conveyor may be part of a work string instead of the drill string 2. If rotation of the work string is not required, the top drive may be omitted and the pipe handler 8 connected to a Kelly swivel. Alternatively, the pipe handler 8 may be used to assemble any other type of oilfield country tubular, such as casing, liner, or wellscreen.

A wellhead (not shown) may be mounted on a conductor pipe which has been cemented into the wellbore. The BOP may be connected to the wellhead, such as by a flanged connection. The wellbore may be terrestrial or subsea. If terrestrial, the wellhead may be located at a surface of the earth and the drilling rig 1 may be disposed on a pad adjacent to the wellhead. If subsea, the wellhead may be located on the seafloor or adjacent to the waterline and the drilling rig may be located on an offshore drilling unit or a platform adjacent to the wellhead.

The drill string 2 may be used to extend the wellbore through an upper formation (not shown) and/or lower formation (not shown). The upper formation may be nonproductive and the lower formation may be a hydrocarbon-bearing reservoir. Alternatively, the lower formation may be non-productive (e.g., a depleted zone), environmentally sensitive, such as an aquifer, or unstable.

The fluid handling system may include a mud pump, a drilling fluid reservoir, such as a pit or tank, a solids separator, such as a shale shaker, a return line, a feed line, and a supply line. A first end of the return line may be connected to the wellhead and a second end of the return line may be connected to an inlet of the shaker. A lower end of the supply line may be connected to an outlet of the mud pump and an upper end of the supply line may be connected to the inlet 5*i* of the top drive 5. A lower end of the feed line may be connected to an outlet of the pit and an upper end of the feed line may be connected to an inlet of the mud pump.

During the drilling operation, the mud pump may pump the drilling fluid from the pit, through the supply line to the top drive 5. The drilling fluid may include a base liquid. The base liquid may be refined or synthetic oil, water, brine, or a water/oil emulsion. The drilling fluid may further include solids dissolved or suspended in the base liquid, such as organophilic clay, lignite, and/or asphalt, thereby forming a mud. The drilling fluid may flow from the supply line and into the drill string 2 via the top drive 5. The drilling fluid may be pumped down through the drill string 2 and exit the drill bit, where the fluid may circulate the cuttings away from the bit and return the cuttings up an annulus formed between an inner surface of the wellbore and an outer surface of the drill string 2. The returns (drilling fluid plus cuttings) may flow up the annulus to the wellhead and be diverted through the return line and into the shale shaker. The shale shaker may process the returns to remove the cuttings and discharge the processed fluid into the mud pit, thereby completing a cycle. As the drilling fluid and returns circulate, the drill string 2 may be rotated by the top drive 5 and lowered by the traveling block 9, thereby extending the wellbore.

Figure 2A:
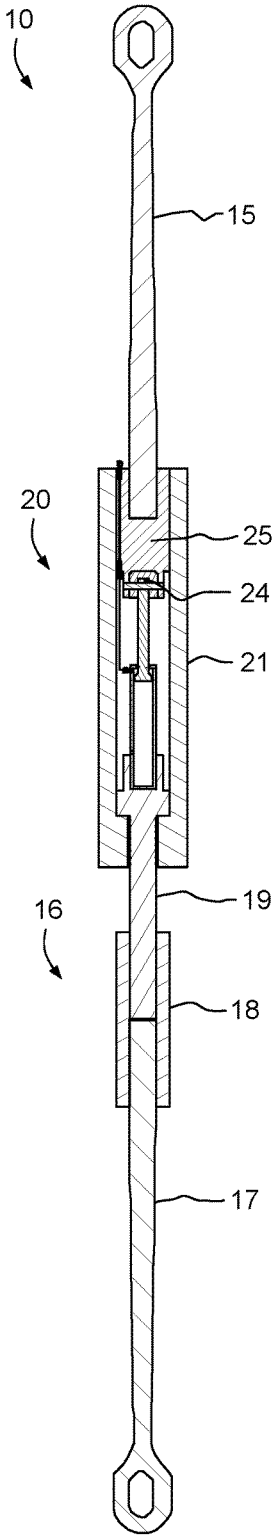
FIG. 2A illustrates one of the compensating bails of the drilling rig.
Figure 2B:
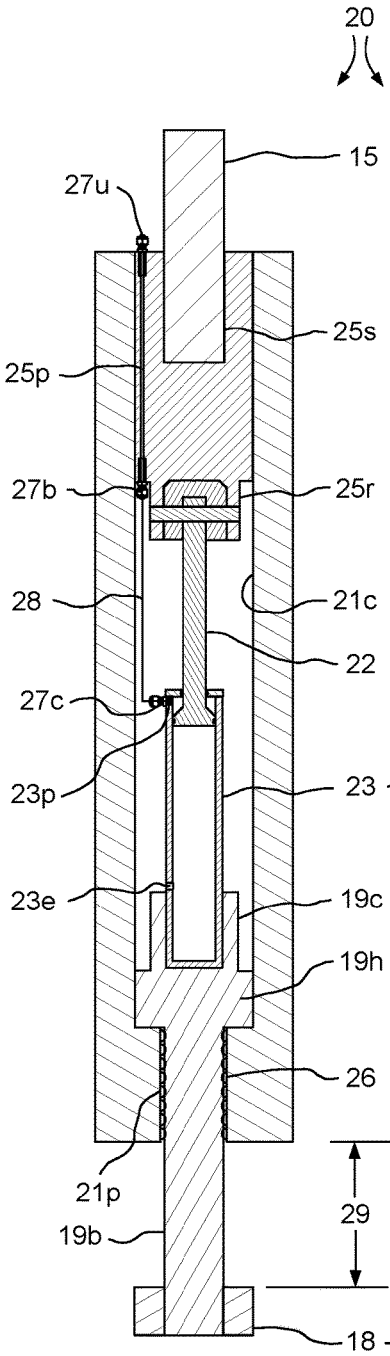
FIGS. 2B and 2C illustrate an integral compensator of the bail.
Figure 2C:
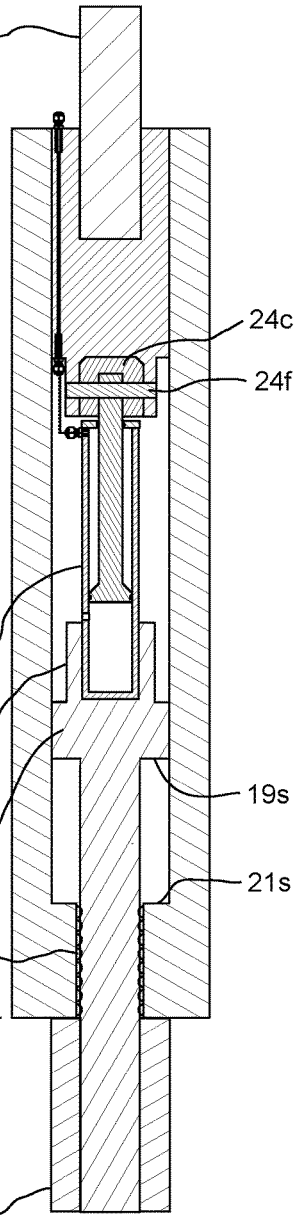

FIG. 2A illustrates one of the compensating bails 10. FIGS. 2B and 2C illustrate an integral compensator 20 of the bail 10. Each compensating bail 10 may include an upper bail segment 15, a lower bail segment 16, and the compensator 20 connecting the bail segments. As discussed above, each bail segment 15, 16 may have an eyelet formed at a longitudinal end thereof for connection to the respective top drive frame and the elevator 8*e*. To facilitate assembly, the lower bail segment 16 may include an adapter 19 and a link 17, each having a threaded coupling, such as a pin, formed at a longitudinal end thereof and connected by a coupling 18 having respective threads, such as boxes formed in an inner surface thereof. The bail segment 15, 16 may have an equal or substantially equal length or one of the bail segments may be substantially longer than the other bail segment.

Each compensator 20 may include a load cylinder 21, a linear actuator, such as a pneumatic piston 22 and cylinder 23 assembly (PCA), a flex joint 24, an upper adapter 25, and a linear bearing 26. The lower adapter 19 of the lower bail segment 16 may have a crown 19*c*, a head 19*h*, a body 19*b*, and a shoulder 19*s* formed between the head and the body. The load cylinder 21 may have a chamber 21*c*, a shoulder 21*s*, and a passage 21*p*. The passage 21*p* may be formed through an end portion of the load cylinder 21 and the shoulder 21*s* may be formed at the end portion. The head 19*h* may be disposed in the chamber 21*c* and have a sliding fit relative to an inner wall of the load cylinder 21 and the body 19*b* may extend through the passage 21*p* and be transversely supported by the linear bearing 26, thereby forming a bending moment connection between the lower bail segment 16 and the load cylinder 21 while allowing relative longitudinal movement therebetween. A housing of the linear bearing 26 may be connected to the load cylinder 21, such as by an interference fit. A lower end of the PCA 22, 23 may be connected to the lower bail segment 16, such as by the pneumatic cylinder 23 having a threaded outer surface at a lower end thereof and the crown 19*c* having a complementary threaded inner surface.

An upper end of the PCA 22, 23 may be connected to the upper adapter 25 by the flex joint 24. The flex joint 24 may be a spherical bearing longitudinally connecting the piston 22 to the upper adapter 25 while allowing articulation of the PCA 22, 23 relative to the adapter to accommodate bending moment. The flex joint 24 may include a bearing cap 24*c* having a curved, such as toroidal, outer surface, a complementary bearing race 25*r*, and a fastener 24*f* connecting the bearing cap to the bearing race, connecting the bearing race to the upper adapter 25, and connecting the bearing cap to an upper end of the piston 22. Although shown schematically as a pin, the fastener 24*p* may include multiple fasteners of varying types to make the connections between the members of the flex joint 24. Although shown schematically as integral with the adapter 25, the bearing race 25*r* may be a separate member connected thereto. The flex joint 24 may further include a coating or liner of lubricative material (not shown) disposed or coated in/on the bearing cap 24*c* and/or bearing race 25*r* or the flex joint 24 may be packed with a lubricant, such as grease.

Each PCA 22, 23 may be pneumatically driven by the control line 13*n* extending from the manifold 13*m*. The upper adapter 25 may be disposed in the chamber 21*c* and connected to the load cylinder 21, such as by threaded couplings or fasteners. The upper adapter 25 may have a threaded socket 25*s* formed in an upper portion thereof for receiving a threaded lower end of the upper bail segment 15, thereby connecting the upper adapter and the upper bail segment. The upper adapter 25 may have a fluid passage 25*p* formed therethrough and a fitting 27*u,b* connected at each end of the passage. An upper fitting 27*u* may receive an upper end of the control line 13*n* and a lower fitting 27*b* may receive an upper end of a flexible jumper 28.

The piston 22 may be disposed in a chamber of the pneumatic cylinder 23, thereby dividing the chamber into an upper portion and a lower portion. A shoulder of the piston 22 may carry a seal for engaging an inner surface of the pneumatic cylinder 23 and a cap of the pneumatic cylinder may carry a seal for engaging a shaft portion of the piston. The pneumatic cylinder 23 may have a pneumatic port 23*p* formed through a wall thereof and in fluid communication with the upper portion of the pneumatic cylinder chamber. A fitting 27*c* may be connected to the pneumatic cylinder 23 at the port 23*p* and may receive a lower end of the flexible jumper 28, thereby providing fluid communication between the control line 13*n* and the PCA 22, 23. The pneumatic cylinder 23 may also have a equalization port 23*e* formed through a wall thereof and in fluid communication with the lower portion of the pneumatic cylinder chamber, thereby providing fluid communication between the lower portion and the load cylinder chamber 21*c*.

The lower bail segment 16 and pneumatic cylinder 23 may be longitudinally movable relative to the load cylinder 21 and the upper bail segment 15 between a hoisting position (FIG. 2B) and a ready position (FIG. 2C). The lower bail shoulder 19*s* may be seated against the load cylinder shoulder 21*s* in the hoisting position and a bottom of the load cylinder 21 may be seated against a top of the coupling 18 in the ready position. A stroke length 29 between the ready and hoisting positions may correspond to, such as being equal to or slightly greater than, a makeup length of the drill pipe couplings. Resting the lower bail segments 16 on the respective load cylinders 21 in the hoisting position may provide a more robust support than the PCAs 22, 23 in the ready position so that string weight may be supported by the bail segments 15, 16 and the load cylinders 21 instead of the PCAs 22, 23 which may only be capable of supporting weight of a joint or stand of joints (plus the elevator 8*e* and the lower bails 16).

Each compensating bail 10 may further include the hinge knuckle (not shown, see FIG. 1) for receiving the lower end of the respective link tilt 8*t*. The hinge knuckle may be connected to the load cylinder 21, such as by one or more fasteners. Alternatively, the hinge knuckle may be connected to the upper bail segment 15. Alternatively, the link tilt lower end may connect to the lower bail segment 16 by a slide hinge. Alternatively, the link tilt lower end may be pivotally connected to the lower bail segment 16 and the link tilt upper end may connect to the top drive frame by a slide hinge.

Alternatively, each PCA 22, 23 may be hydraulically driven. Alternatively, the compensating bails 10 may each include an electro-mechanical linear actuator, such as a motor and lead screw, instead of the PCAs 22, 23. Alternatively, each compensating bail 10 may be used upside down. Alternatively, the flex joint 24 may connect the pneumatic cylinder 23 to the lower bail segment 16 or each compensating bail 10 may include a second flex joint connecting the pneumatic cylinder 23 to the lower bail segment 16. Alternatively, the pneumatic cylinder 23 may be connected to the lower bail segment 16 by one or more fasteners.

Figure 3:
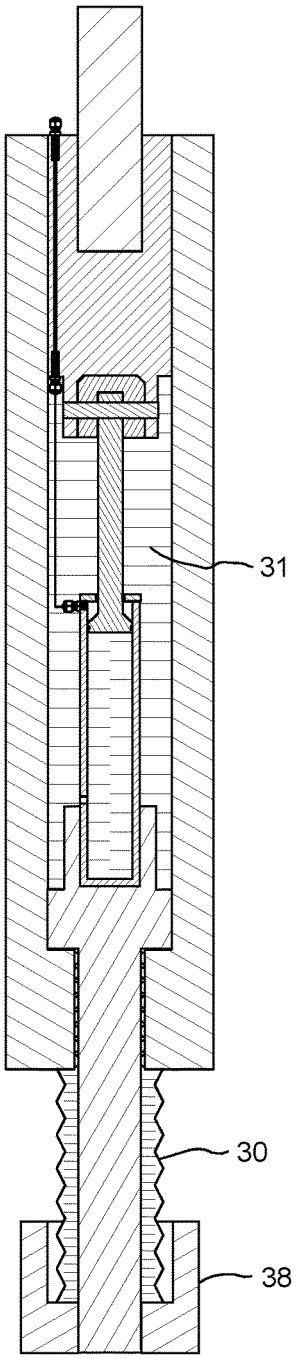
FIG. 3 illustrates an alternative compensator for use with the bails.

FIG. 3 illustrates an alternative compensator for use with each bail. The alternative compensator may further include an expansion joint, such as bellows 30, and/or the load cylinder chamber may be filled with liquid lubricant 31, such as bearing oil. The bellows 30 may seal the upper segment body-passage interface to prevent debris for fouling the compensator and/or for retaining the liquid lubricant 31 in the chamber and passage. The alternative compensator may include a modified coupling 38 having a recess for receiving a lower end of the bellows 30.

FIGS. 4A-4D illustrate extension of the drill string 2 using the compensating bails 10. During drilling of the wellbore, once a top of the drill string 2 reaches the rig floor 4, the drill string may then require extension to continue drilling. Drilling may be halted by stopping advancement and rotation of the top drive 5 and removing weight from the drill bit. A spider 14 (FIG. 1) may then be operated to engage an upper end of the drill string 2, thereby longitudinally supporting the drill string from the rig floor 4. The backup wrench arm actuator may be operated to lower the backup wrench tong to a position adjacent a top coupling of drill string 2. The backup wrench tong actuator may then be operated to engage the backup wrench tong with the top coupling. The backup wrench arm actuator may then be operated as a thread compensator and the top drive motor 5*m* operated to loosen and spin the connection between the quill 5*q* and the top coupling.

Once the connection between the quill 5*q* and the top coupling has been unscrewed, the top drive 5 may then be raised by the drawworks 12*d* until the elevator 8*e* is proximate to a top of the stand 11. The elevator 8*e* may be opened (or already open) and the link tilt 8*t* operated to swing the elevator into engagement with the top coupling of the stand 11. The elevator 8*e* may then be closed to securely grip the stand 11. The compensating bails 10 may be in the hoisting position. The top drive 5 and stand 11 may then be raised by the drawworks 12*d* and the link tilt 8*t* operated to swing the stand over and into alignment with the drill string 2. The compensating bails 10 may then be stroked 40*u* to the ready position by supplying compressed air to the PCAs 22, 23 from the fluid power unit 13, thereby slightly raising the stand 11 and shifting weight of the stand 11 to the PCAs 22, 23.

The top drive 5 and stand 11 may be lowered and a bottom coupling of the stand 11 stabbed into the top coupling of the drill string 2. A spinner (not shown) may be engaged with the stand 11 and operated to spin the stand 11 relative to the drill string 2, thereby beginning makeup of the threaded connection. A pneumatic pressure may be maintained in the PCAs 22, 23 corresponding to the weight of the stand 11 (plus lower bails 16 and elevator 8*e*) so that the stand 11 is maintained in a neutral or substantially neutral condition during makeup. A pressure regulator of the manifold 13*m* may relieve fluid pressure from the PCAs 22, 23 as the stand 11 is being madeup to the drill string 2 to maintain the neutral condition while the lower bail segment 16 and pneumatic cylinder 23 stroke downward 40*d* to accommodate the longitudinal displacement of the threaded connection. A drive tong 41*d* may be engaged with a bottom coupling of the stand 11 and a backup tong 41*b* may be engaged with a top coupling of the drill string 2. The drive tong 41*d* may then be operated to tighten the connection between the stand 11 and the drill string 2, thereby completing makeup of the threaded connection.

Once the connection has been tightened, the tongs 41*d,b* may be disengaged. The elevator 8*e* may be partially opened to release the stand 11 and the top drive 5 lowered relative to the stand. Fluid pressure may be relieved from the PCAs 22, 23 so that the lower bail segment 16 moves downward 42 until the shoulder 19*s* engages the load cylinder shoulder 21*s* (hoisting position). The backup wrench arm actuator may be operated to lower the backup wrench tong to a position adjacent the top coupling of the stand 11. The backup wrench tong actuator may then be operated to engage the backup wrench tong with the top coupling of the stand 11, the elevator 8*e* may be fully opened, and the link-tilt operated to clear the elevator. The arm actuator may then be operated as the thread compensator and the top drive motor 5*m* operated to spin and tighten the threaded connection between the quill 5*q* and the stand 11. The spider 14 may then be operated to release the drill string 2 and drilling may continue with the drill string extended by the stand 11.

Figure 5:
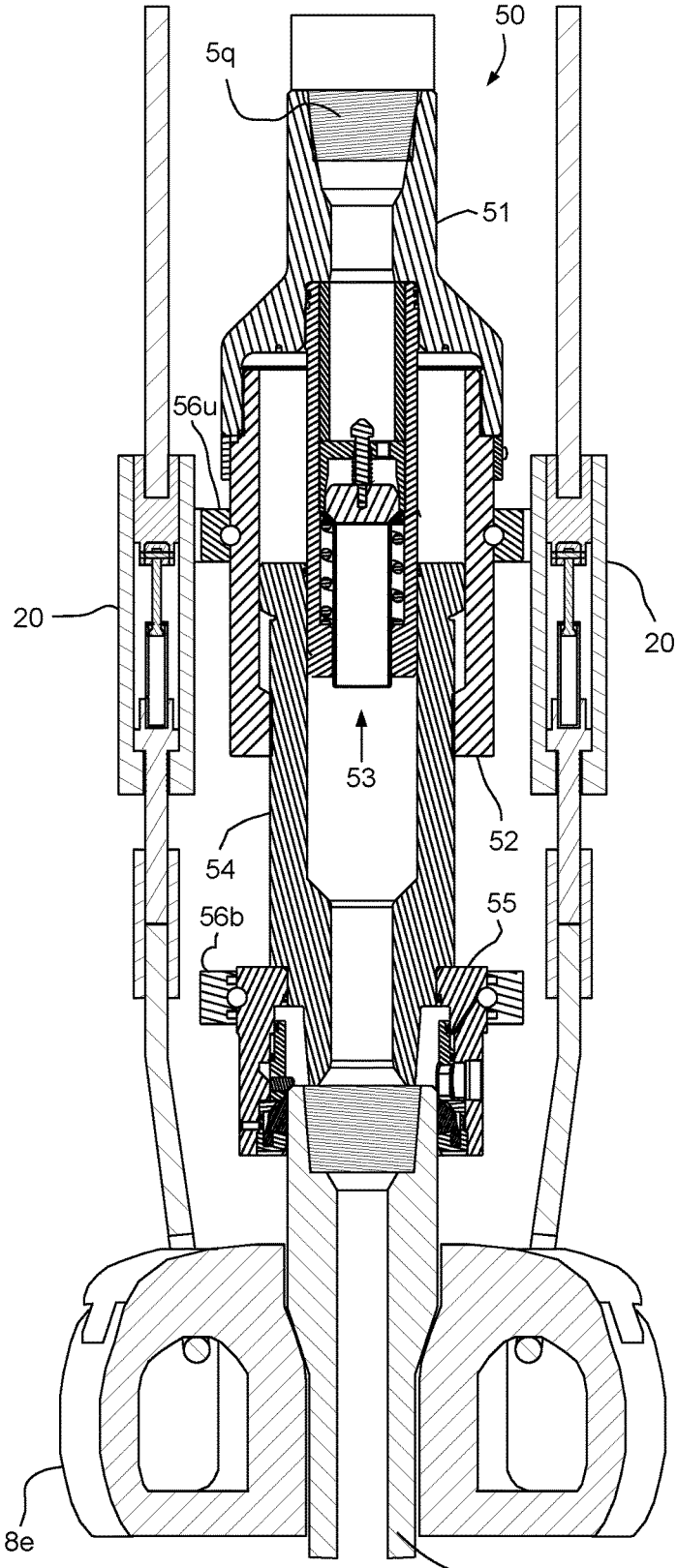
FIG. 5 illustrates a flowback tool for tripping drill pipe with the compensating bails, according to another embodiment of the present disclosure.

FIG. 5 illustrates a flowback tool 50 for tripping drill pipe 2*p* with the compensating bails, according to another embodiment of the present disclosure. If the drill string 2*p* (or work string) is being tripped into the wellbore and does not require rotation thereof during tripping, the flowback tool 50 may be connected to the top drive quill 5*q* and used for lowering the drill string instead of making up the connection between the quill and the top coupling of the stand 11. The upper and/or lower bails 15, 16 may be replaced with longer bails to accommodate the addition of the flowback tool 50.

The flowback tool 50 may include a cap 51, a housing 52, a mud saver valve 53, a mandrel 54, a nose 55, and a linear actuator 56*u,b* (only partially shown). The mandrel 54 and the nose 55 may be longitudinally movable relative to the housing 52 between a retracted position and an engaged position by the actuator 56*u,b*. The nose 55 may sealingly engage an outer surface of the drill pipe 2*p* in the engaged position, thereby providing fluid communication between the top drive 5 and the bore of the drill pipe.

The flowback actuator may include two or more PCAs (not shown), an upper swivel 56*u*, and a lower swivel 56*b*. Each flowback PCA may be longitudinally coupled to the housing 51 via the upper swivel and longitudinally coupled to the nose 55 via the lower swivel. The upper swivel 56*u* may include arms for engaging the load cylinders 20, thereby torsionally coupling the flowback PCAs to the compensating bails 10. Each of the swivels 56*u,b* may include one or more bearings, thereby allowing relative rotation between the flowback PCAs and the housing 52. The control line 13*n* may further include hydraulic or pneumatic conduits to provide for extension and retraction of the flowback PCAs and operation of the nose 55 via a port thereof.

The flowback cap 51 may be annular and have a bore therethrough. An upper longitudinal end of the cap 51 may include a threaded coupling, such as a box, for connection with a threaded coupling of the quill 5*q*, such as a pin, thereby longitudinally and torsionally connecting the quill and the cap. The cap 51 may taper outwardly so that a lower longitudinal end thereof may have a substantially greater diameter than the upper longitudinal end. An inner surface of the cap lower end may be threaded for receiving a threaded upper longitudinal end of the housing 52, thereby longitudinally connecting the cap and the housing.

The flowback housing 52 may be tubular and have a bore formed therethrough. An outer surface of the housing 52 may be grooved for receiving the bearings, such as ball bearings, thereby longitudinally connecting the housing and the upper swivel 56*u*. A lower longitudinal end of the housing 52 may be longitudinally splined for engaging longitudinal splines formed on an outer surface of the mandrel 54, thereby torsionally connecting the housing and the mandrel. The housing lower end may form a shoulder for receiving a corresponding shoulder formed at an upper longitudinal end of the mandrel 54, thereby longitudinally connecting the housing and the mandrel in a hoisting position. The flowback PCAs may be capable of supporting weight of the nose 55 and the mandrel 54 and the shoulders, when engaged, may be capable of supporting weight of the drill string 2. The shoulders may engage before the flowback PCAs are fully extended, thereby ensuring that string weight is not transferred to the flowback PCAs.

A lower longitudinal end of the flowback mandrel 54 may form a threaded coupling, such as a pin, for engaging a threaded coupling, such as a box, formed at a upper end of the drill pipe 2*p* if shifting the flowback tool to a well control mode becomes necessary. An outer surface of the mandrel 54 adjacent to the lower longitudinal end may be threaded and form a shoulder for receiving a threaded inner surface and shoulder of the nose 55, thereby longitudinally and torsionally connecting the nose and the mandrel. One or more seals may be disposed between the mandrel 54 and the nose 55, thereby isolating a seal chamber of the nose from an exterior of the flowback tool 50. A substantial portion of the mandrel bore may be sized to receive the mudsaver valve 53.

The flowback nose 55 may include a body, a piston, one or more fasteners, such as dogs, a seal retainer, a seal, a stop, and a valve. The nose body may be annular and have a bore therethrough. The nose body may include a groove formed in an outer surface for receiving bearings, such as balls. A port may be formed through the wall of the nose body providing fluid communication between the groove and an outer surface of the nose piston. The nose body may include one or more slots formed in an inner surface for receiving respective dogs. Each slot may have an inclined face for radially moving the dogs from a retracted position to an extended position as the nose piston moves longitudinally relative to the nose body.

The nose piston may include corresponding slots formed therethrough for receiving the dogs. Each piston slot may include a lip (not shown) for abutting a respective lip (not shown) formed in each dog, thereby radially retaining the dogs in the slot. Each dog may include a tapered inner surface for engaging an end of the drill pipe 2*p* when the drill pipe is being moved longitudinally relative to the nose body from the locked position to the well control position, thereby longitudinally moving the piston and radially moving the dogs from the extended position to the retracted position. The nose body may include a groove formed in an inner surface for receiving a seal, such as an o-ring, for engagement with the mandrel 54.

The nose body may include a vent formed through a wall thereof and in fluid communication with a seal chamber, defined by a portion of the nose bore between the seal and the mandrel seal, and the valve for safely disposing of residual fluid left in the seal chamber before disengaging the drill pipe 2*p*. The vent may be threaded for receiving a threaded coupling of the valve, thereby longitudinally and torsionally connecting the valve and the body. The body may include a recess formed at a lower longitudinal end thereof for receiving the seal retainer and the stop. One or more holes may be formed through the housing wall for receiving fasteners, such as set screws, thereby longitudinally connecting the seal retainer and the nose body. The nose body may include a profile formed therein for receiving a corresponding profile formed in an outer surface of the nose piston.

The nose piston may be annular and have a bore formed therethrough. The nose piston may be disposed in the nose body and longitudinally movable relative thereto between a locked position and the unlocked position. The nose piston may include the profile on the outer surface thereof. Upper and lower seals may be disposed between the nose piston and the nose body (on piston as shown) so as to straddle the port, thereby isolating a piston chamber from the remainder of the nose 55. A shoulder may be formed as part of the piston profile, thereby providing a piston surface. The nose piston may have a port formed therethrough in alignment with the vent when the piston is in the locked position and partially aligned with the vent when the piston is in the unlocked position. The nose piston may abut the stop in the locked position. The nose 55 and/or the lower longitudinal end of the mandrel 54 may be configured so that the nose and the mandrel are biased away (i.e., upward) from the drill pipe 2*p* in the engaged position by fluid pressure from the workstring 2*p*.

The nose seal retainer may be annular and may have a substantially J-shaped cross section for receiving and retaining the seal. The nose seal may include a base portion having a lip for engaging a corresponding lip of the retainer and a cup portion for engaging the outer surface of the drill pipe 2*p*. An outer surface of the cup portion may be inclined for receiving fluid pressure to press the cup portion into engagement with the drill pipe 2*p*. When engaged, the cup portion may be supported by a tapered inner surface of the nose stop and/or the nose piston. The seal may be molded into the retainer or pressed therein. The nose stop may abut a shoulder of the recess and an upper longitudinal end of the retainer, thereby longitudinally connecting the stop and the nose body.

In operation, once the stand 11 is made up with the drill string 2, hydraulic/pneumatic fluid from the manifold 13*m* may be injected into the nose 55 via the lower swivel 56*b*, thereby locking the nose piston or moving the piston into the locked position and locking the piston. Hydraulic/pneumatic pressure may be maintained on the nose piston during advancement of the drill string 2 into the wellbore, thereby locking the nose piston and the dogs. Hydraulic/pneumatic fluid may be then injected into the flowback PCAs, thereby lowering the nose 55 and the mandrel 54 until an outer surface of the drill pipe box engages the nose seal and then the dogs with the top coupling of the stand 11. Hydraulic/pneumatic pressure may be maintained on the PCAs during advancement of the drill string 2 into the wellbore, thereby overcoming the upward bias from fluid pressure and ensuring that the dogs and nose seal remain engaged to the drill pipe 2*p* during advancement of the into the wellbore. Engagement of the nose seal with the drill pipe box may provide fluid communication between the drill string 2 and the top drive 5, thereby allowing: the stand 11 to be filled with drilling fluid and/or injection of drilling fluid through the drill string 2 during advancement thereof into the wellbore.

Once the drill string 2 has been advanced into the wellbore and requires another stand for further advancement, the spider 14 may be set. The valve may be connected to a disposal line (not shown) and fluid may be bled through the vent by opening the valve. Hydraulic pressure to the flowback PCAs may be reversed, thereby raising the nose 55 and the mandrel 54 to the retracted position. Hydraulic/pneumatic pressure may be relieved from the nose piston. The pipe handler 8 may then release the drill string 2. The top drive 5 may be moved proximate to another stand and the pipe handler 8 operated to grab the stand. The stand may be moved into position over the drill string 2 and madeup therewith. The flowback tool 50 may then again be operated by repeating the cycle.

FIGS. 6A-6F illustrate the drilling rig in a casing mode and extension of a casing string 62 using compensating bails, according to another embodiment of the present disclosure. Once drilling the formation has completed, the drill string 2 may be tripped out using the flowback tool 50 or connection to the quill 5*q* depending on whether rotation is desired during tripping out. Once the drill string 2 has been retrieved to the rig 1, a seal head 63 may be connected to the quill 5*q* and the pipe handler 8 replaced with a casing pipe handler.

The casing pipe handler may be similar to the pipe handler 8 except for substitution of a casing elevator 68*e* for the elevator 8*e* and substitution of a casing compensator 60 for each compensator 20. Each compensator 60 may be similar to the compensator 20 except for having a stroke length substantially greater than a makeup length of the casing couplings. The casing elevator 68*e* may be similar to the elevator 8*e* except for being sized to handle a joint 61 of casing 62*c*. The casing pipe handler may be used to assemble the casing joint 61 with the casing string 62 in a similar fashion as with the drill string 2, discussed above with a few exceptions.

Alternatively, the casing elevator 68*e* may have a gripper, such as slips and a cone, capable of engaging an outer surface of the casing joint 61 at any location therealong.

The seal head 63 may include an adapter 63*a*, a mandrel 63*m*, a packoff 63*p*, and a guide 63*g*. The adapter 63*a* may have a threaded upper coupling for connection to the quill 5*q* and a threaded lower coupling for connection to the mandrel 63*m*. The mandrel 63*m* may have a threaded upper coupling and a threaded lower coupling for connection of the guide 63*g*. The packoff 63*p* may be disposed along the mandrel 63*m* between an upper shoulder thereof and the guide 63*g*. The seal head 63 may have a bore formed therethrough for providing fluid communication between the quill 5*q* and the casing string bore when engaged with the casing joint 61.

After the casing joint 61 is swung into position over the casing string 62 and a bottom coupling of the casing joint stabbed into a top coupling of the casing string, compressed air may be supplied to the PCAs of the compensators 60 so that the casing joint 61 is maintained in the neutral or substantially neutral condition during makeup. The compensating bails may then be stroked 40*u* to the ready position by lowering 70*d* the top drive 5, thereby also stabbing the seal head 63 into the casing joint 61 and engaging the packoff 63*p* with an inner surface thereof. Power tongs 41*p* may be used to spin and tighten the threaded connection between the casing joint 61 and the casing string 62 instead of the tongs 41*b,d* and spinner. The pressure regulator may relieve fluid pressure from the PCAs as the casing joint 61 is being madeup to the casing string 62 while the compensators 60 stroke downward 40*d* to accommodate longitudinal displacement of the threaded connection. Once the threaded casing connection has been madeup, fluid pressure may be relieved from the PCAs and the top drive 5 raised 70*u* to stroke 42 the compensators 60 to the hoisting position for supporting weight of the entire casing string 62. The spider 14 may then be disengaged from the casing string 62 and the pipe handler used to support the casing string 62 while lowering the casing string into the wellbore.

Although the seal head 63 may disengage the casing string 62 during stroking 42 to the hoisting position, the seal head may be reengaged with the casing string should a well control event occur while lowering the casing string into the wellbore by reengaging the spider 14 with the casing string 62 and lowering the top drive 5 until the packoff engages the casing string inner surface.

Alternatively, the compensating bails may be stroked 40*u* to the ready position before supplying compressed air may to the PCAs of the compensators 60 such that the casing elevator 68*e* may slide down along the casing joint 61 and then be lifted back into engagement with the coupling.

Alternatively, the compensators 60 may have a stroke length corresponding to, such as being equal to or slightly greater than, a makeup length of the casing couplings and/or the casing joint 61 and casing string 62 may be assembled and lowered into the wellbore without using a circulation or flowback tool.

Alternatively, the flow back tool 50 may be modified for use with the casing joint 61 and string 62 by modifying the nose such that the nose seal engages an inner surface of the top casing joint 62*c*. This alternative may be accomplished simply by removing the seal retainer and nose seal from the nose and replacing the seal retainer with an alternative seal retainer (not shown) configured to extend into the casing joint 62*c* and replacing the nose seal with the packoff 63*p*. The alternative casing flow back tool would then be used with the alternative short stroke casing compensators.

Alternatively, the seal head 63 may further include a mudsaver valve. The mudsaver valve may be connected between the adapter 63*a* and the mandrel 63*m* or be connected to the mandrel or guide 63*g* via a hose.

Alternatively, the casing joint 61 and casing string 62 may be assembled and lowered into the wellbore without using the top drive by directly connecting the casing pipe handler and circulation head to a Kelly swivel.

Alternatively, a liner joint and liner string may be assembled and lowered into the wellbore instead of the casing joint 61 and casing string 62. Alternatively, a wellscreen joint or stand and wellscreen string may be assembled and lowered into the wellbore instead of the casing joint 61 and casing string 62.

Alternatively, the compensators 20 may have a stroke length sufficient for being used with both drill pipe and casing joints.

While the foregoing is directed to embodiments of the present disclosure, other and further embodiments of the disclosure may be devised without departing from the basic scope thereof, and the scope of the invention is determined by the claims that follow.

The invention claimed is:

1. A pipe handler for assembling and deploying a string of threaded tubulars into a wellbore, comprising:

at least one compensating bail comprising: a first bail segment; a second bail segment; and a compensator connecting the first and second bail segments;

wherein:

the compensator comprises:

a load cylinder connected to the first bail segment; and a piston and cylinder assembly disposed in a chamber of the load cylinder and operable to retract the second bail segment from a hoisting position to a ready position, the second bail segment is engaged with the load cylinder in the hoisting position.

2. The pipe handler of claim 1, wherein a stroke length of the piston and cylinder assembly corresponds to a makeup length of threaded connections between the tubulars.

3. The pipe handler of claim 1, wherein a stroke length of the piston and cylinder assembly is substantially greater than a makeup length of threaded connections between the tubulars.

4. The pipe handler of claim 1, wherein:

the second bail segment has a head disposed in the chamber of the load cylinder and a body extending through a passage formed through an end portion of the load cylinder, and a sliding fit is formed between the head and an inner wall of the load cylinder.

5. The pipe handler of claim 4, wherein the at least one compensating bail further comprises:

an adapter connecting the first bail segment to the load cylinder;

a flex joint connecting the adapter to the piston and cylinder assembly; and a linear bearing disposed in the passage.

6. The pipe handler of claim 4, wherein the at least one compensating bail is capable of supporting string weight in the hoisting position.

7. The pipe handler of claim 6, wherein the second bail segment comprises an adapter, a link, and a coupling connecting the adapter and link.

8. The pipe handler of claim 7, wherein the coupling engages an exterior surface of the end portion in the ready position.

9. The pipe handler of claim 4, wherein the at least one compensating bail further comprises an expansion joint sealing an interface between the body and the passage.

10. The pipe handler of claim 9, wherein the at least one compensating bail further comprises liquid lubricant filling the chamber.

11. The pipe handler of claim 4, further comprising a port formed through a wall of the piston and cylinder assembly and in fluid communication with the chamber.

12. The pipe handler of claim 1, wherein the at least one compensating bail further comprises:

an adapter connecting the first bail segment to the load cylinder and having a fluid passage formed therethrough; and a flexible jumper connecting the fluid passage to a port formed through a wall of the piston and cylinder assembly.

13. The pipe handler of claim 1, further comprising a link tilt pivotally connected to the at least one compensating bail.

14. A method of assembling and deploying a string of threaded tubulars into a wellbore, comprising:

engaging a pipe handler with one or more joints of the threaded tubulars, wherein the pipe handler has at least one bail, the at least one bail having an integral compensator including a load cylinder;

lifting and swinging the joints over the string using the pipe handler;

actuating a piston and cylinder assembly disposed in a chamber of the load cylinder;

moving the pipe handler between a hoisting position and a ready position using the piston and cylinder assembly; and making up a threaded connection between the joints and the string while actuating the piston and cylinder assembly.

15. The method of claim 14, further comprising supporting the assembled joints and string with the pipe handler.

16. The method of claim 14, further comprising:

after makeup, operating the piston and cylinder assembly to return the at least one bail to the hoisting position; and supporting the assembled joints and string with the pipe handler.

17. The method of claim 14, wherein:

a stroke length of the piston and cylinder assembly is substantially greater than a makeup length of threaded connections between the tubulars, and a seal head is stabbed into a top of the joints while moving the at least one bail to the ready position.

18. A method of assembling and deploying a string of threaded tubulars into a wellbore, comprising:

engaging a pipe handler with one or more joints of the threaded tubulars, wherein the pipe handler has an elevator and at least one bail, the at least one bail having an integral compensator including a load cylinder;

hoisting and swinging the joints over the string using the pipe handler;

actuating a piston and cylinder assembly disposed in a chamber of the load cylinder;

stabbing the joints into the string; and making up a threaded connection between the joints and the string while actuating the piston and cylinder assembly to maintain the joints in a substantially neutral condition.

19. The method of claim 18, further comprising:

after makeup, operating the piston and cylinder assembly to move the at least one bail to a hoisting position; and supporting the assembled joints and string with the pipe handler.

20. The method of claim 19, wherein a seal head is stabbed into a top of the joints while moving the at least one bail to a ready position.

* * * * *